United States Patent [19]

Godsey

[11] 4,298,411

[45] Nov. 3, 1981

[54] CROSSLINKED SMOKELESS PROPELLANTS

[75] Inventor: James H. Godsey, Cumberland, Md.

[73] Assignee: Hercules Incorporated, Wilmington, Del.

[21] Appl. No.: 842,088

[22] Filed: Jul. 14, 1969

[51] Int. Cl.[2] ..... C06B 45/10

[52] U.S. Cl. ..... 149/19.4; 149/94; 149/95; 149/96; 149/98; 149/100; 149/92

[58] Field of Search ..... 149/94, 95, 96, 97, 149/98, 100, 19; 264/3

[56] References Cited

U.S. PATENT DOCUMENTS

| | | | |
|---|---|---|---|
| 3,028,274 | 4/1962 | Winer | 149/98 |
| 3,032,972 | 5/1962 | Preckel | 149/98 X |
| 3,088,858 | 5/1963 | Camp | 149/98 X |
| 3,102,834 | 9/1963 | Camp et al. | 149/98 X |
| 3,138,499 | 6/1964 | Camp et al. | 149/98 X |
| 3,228,815 | 1/1966 | Henry et al. | 149/98 |
| 3,344,004 | 9/1967 | Desmarais | 149/44 X |
| 3,379,588 | 4/1968 | Corsi et al. | 149/95 X |
| 3,445,306 | 5/1969 | Satriana | 149/96 |
| 3,507,720 | 4/1970 | Peterson | 149/60 |

*Primary Examiner*—Stephen J. Lechert, Jr.
*Attorney, Agent, or Firm*—Michael B. Keehan

[57] ABSTRACT

Smokeless crosslinked double-base propellant compositions having good mechanical properties over a wide temperature range are provided. The propellant compositions contain nitrocellulose, energetic plasticizer, a crosslinking agent which is a prepolymer of a hydroxy terminated polyester and a diisocyanate, lead salt and carbon black.

13 Claims, No Drawings

CROSSLINKED SMOKELESS PROPELLANTS

This invention relates to a new class of propellants which are both smokeless and have good mechanical properties over a wide temperature range, making them particularly suitable for use in tactical missiles. More particularly, this invention relates to slurry-cast double-base propellant in which nitrocellulose is crosslinked with a prepolymer prepared by reaction of a hydroxy terminated polyester and a diisocyanate, said crosslinking being catalyzed with lead salts. In still another aspect this invention relates to a process for manufacture of smokeless slurry cast double-base propellant for use in tactical missile systems.

Tactical missile systems require propellants which function effectively over a wide temperature range. In addition to good propellant mechanical properties these propellants oftentimes must be smokeless. Smokeless propellants produce substantially no exhaust products which can be observed visually during burning of the propellant.

Composite type propellants generally employ ammonium perchlorate as oxidizer and aluminum as fuel and are unsuitable for weapon systems requiring smokeless propellants because of large quantities of particulate matter in the form of oxides and chlorides of aluminum in the rocket exhaust which are visually observable as smoke. While double-base propellants have been employed in some tactical missiles and will meet smokelessness requirements, these propellants often have marginal mechanical properties at low operational temperatures and are generally unsuitable for this reason. Composite modified double-base propellants normally contain aluminum and oftentimes contain an oxidizing salt such as ammonium perchlorate. The aluminum in these formulations is responsible for production of smoke due to formation of various oxides of aluminum and chlorides of aluminum when ammonium perchlorate is employed in the propellant.

Accordingly, it is the object of this invention to provide propellant compositions which have the unique combination of being both somkeless and having good mechanical properties over a wide operational temperature range.

It is another object of this invention to provide a process for manufacture of the smokeless crosslinked double-base propellants having good mechanical properties over a wide temperature range.

Other objects of this invention will, in part, be obvious and will, in part, appear hereinafter. For a complete understanding of the nature and objects of this invention, reference is made to the following detailed description.

In accordance with this invention a smokeless crosslinked double-base propellant is provided, said propellant composition comprising from about 7% to about 17.0% nitrocellulose, from about 27% to about 63% energetic plasticizer, from about 4% to about 12% prepolymer of a hydroxy terminated polyester and a diisocyanate, from 0% to about 8% non-energetic plasticizer, from about 0.5% to about 6% lead salt, from about 0.1 to about 0.9% carbon black and from 0% to about 60% by weight of an oxidizer selected from the group consisting of cyclotetramethylene tetranitramine (HMX) cyclotrimethylene trinitramine (RDX) and mixtures thereof.

The propellant compositions of this invention are smokeless, have a pressure exponent not exceeding 0.6, a strain capability (elongation) of at least 7% at −65° F. and a tensile strength of at least 50 p.s.i. at 140° F.

The following examples will illustrate the mechanical and ballistic properties of the propellants of this invention and their method of preparation. Parts and percentages are by weight unless otherwise specified.

EXAMPLE 1

A blend comprising two parts lead beta-resorcylate, two parts lead salicylate and 0.2 part carbon black are simultaneously dried for 16 hours at 110° C. The resulting dry blend of lead salts and carbon black is admixed with 4.7 parts of di-n-propyladipate employing a Waring Blendor for 15 minutes until a stiff paste forms. This paste, and 33.3 parts of a liquid casting solvent mixture comprising 14.5% of the prepolymer of polyglycol adipate-tolylene 2,4-diisocyanate, 84% nitroglycerin and 2.5% 2-nitrodiphenylamine are added to a Hobart vertical mixer and agitated for about ten minutes at a temperature of about 120° F. until the mix becomes homogeneous. An additional 33.3 parts of the casting solvent mixture of the same composition and 10 parts of cyclotetramethylene tetranitramine (HMX) are added to the Hobart mixer and mixing is continued for an additional 15 minutes. To this resulting mixture is added 14.5 parts of dry plastisol type nitrocellulose. Mixing is continued for about 25 minutes. A vacuum of about 50 mm mercury or less is then applied to the resulting propellant slurry and mixing is continued for an additional 60 minutes. The slurry is cast into an appropriate mold and the propellant is cured preferably at a temperature of about 140° F. for at least seven days. The resulting propellant composition and properties are listed in Table I below. Propellants manufactured by the procedure set forth in Example 1 are also prepared and their compositions and properties are listed as Examples 2, 3 and 4 in Table I.

TABLE I

| | Propellant Compositions and Properties | | | |
|---|---|---|---|---|
| Example No. | 1 | 2 | 3 | 4 |
| Ingredients* (%) | | | | |
| NC | 14.5 | 11.1 | 7.4 | 7.4 |
| PGA—TDI | 9.7 | 7.4 | 9.1 | 9.1 |
| NG | 55.9 | 42.0 | 43.4 | 48.5 |
| DnPA | 4.7 | 4.0 | 5.1 | — |
| HMX(B) | 10.0 | 29.0 | 29.9 | — |
| RDX(E) | — | — | — | 29.9 |
| NDPA | 1.0 | 0.4 | 1.0 | 1.0 |
| MNA | — | 2.0 | — | — |
| PbSal | 2.0 | 2.0 | 2.0 | 2.0 |
| LBR | 2.0 | 2.0 | 2.0 | 2.0 |
| CB | 0.2 | 0.1 | 0.1 | 0.1 |

TABLE I-continued

| Propellant Compositions and Properties | | | | |
|---|---|---|---|---|
| Example No. | 1 | 2 | 3 | 4 |
| Theoretical Properties | | | | |
| Heat of explosion (cal./g.) | 999 | 1007 | 975 | 1186 |
| Density (lbs./in.$^3$) | 0.0562 | 0.0582 | 0.0578 | 0.0591 |
| Specific Impulse (lbf-sec./lbm) | 231.8 | 234.7 | 232.2 | 246.0 |
| Ballistic Properties | | | | |
| Burning Rate @1000 p.s.i.(in./sec.) | 0.49 | 0.36 | 0.37 | 0.33 |
| Pressure Exponent | 0.39 | 0.35 | 0.32 | 0.42 |

*Ingredient Definitions

| | |
|---|---|
| NC | Nitrocellulose ("Plastisol Nitrocellulose", 12.6%N) |
| PGA—TDI | Prepolymer of polyglycol adipate and tolylene 2,4-di-isocyanate ("Rucoflex Polyester, F-101") |
| NG | Nitroglycerin |
| DnPA | di-n-propyladipate |
| HMX(B) | Cyclotetramethylene tetranitramine (Class B) |
| RDX(E) | Cyclotrimethylene trinitramine (Class E) |
| NDPA | 2-nitrodiphenylamine |
| MNA | N-methyl-p-nitroaniline |
| PbSal | Lead Salicylate |
| LBR | Lead beta-resorcylate |
| CB | Carbon black ("Carbolac 1") |

Table II below contains the results obtained from testing of the propellants prepared in Examples 1, 2, 3 and 4 for mechanical properties.

TABLE II

| Mechanical Properties* | | | | | | | | |
|---|---|---|---|---|---|---|---|---|
| Ex. No. | | Temperature (°F.) | | | | | | |
| | | −70 | −65 | −40 | 0 | 77 | 140 | 160 |
| 1 | Elongation, % | — | 42 | 99 | 130 | 76 | 56 | 52 |
| | Tensile Strength, p.s.i. | — | 1,659 | 839 | 361 | 92 | 60 | 58 |
| | Modulus, p.s.i. | — | 11,447 | 1,296 | 184 | 111 | 128 | 128 |
| 2 | Elongation, % | — | 14 | 52 | 103 | 93 | 78 | 50 |
| | Tensile Strength, p.s.i. | — | 1,745 | 757 | 373 | 136 | 100 | 91 |
| | Modulus, p.s.i. | — | 26,487 | 4,839 | 447 | 205 | 199 | 272 |
| 3 | Elongation, % | 41 | 50 | 74 | 93 | 86 | 68 | 67 |
| | Tensile Strength, p.s.i. | 594 | 494 | 380 | 240 | 112 | 84 | 83 |
| | Modulus, p.s.i. | 8,157 | 4,238 | 1,402 | 490 | 231 | 233 | 231 |
| 4 | Elongation, % | — | 12 | 96 | 110 | 94 | 79 | 81 |
| | Tensile Strength, p.s.i. | — | 620 | 278 | 164 | 67 | 52 | 51 |
| | Modulus, p.s.i. | — | 14,150 | 1,832 | 500 | 174 | 154 | 150 |

*All determinations were made at a strain rate of 0.74 in./min./in.

Each of the propellant compositions of Examples 1, 2, 3 and 4 produce substantially no visually observable exhaust products. Each of these propellants has a pressure exponent not exceeding 0.6 (Table I). The mechanical properties of these propellants, which are set forth in Table II, show that all of the propellants have elongations at −65° F. in excess of 7%, elongations at −40° F. in excess of 50%, and tensile strengths at 140° F. in excess of 50 p.s.i.

The following examples illustrate the wide variations in oxidizer level which can be employed with the propellant compositions of this invention while maintaining the desirable qualities of smokelessness and excellent mechanical properties. These propellant compositions are listed in Table III below.

TABLE III

| Smokeless Propellant Compositions With Varying Oxidizer Levels | | | | | |
|---|---|---|---|---|---|
| | Examples | | | | |
| Ingredients* (%) | 5 | 6 | 7 | 8 | 9 |
| NC | 16.3 | 14.4 | 12.8 | 11.1 | 9.4 |
| PGA-TDI | 10.8 | 9.7 | 8.5 | 7.4 | 6.2 |
| NG | 63.1 | 55.9 | 48.7 | 41.4 | 34.3 |
| DnPA | 4.6 | 4.7 | 4.8 | 4.9 | 4.9 |
| RDX(E) | — | 10.0 | 20.0 | 30.0 | 40.0 |
| NDPA | 1.0 | 1.0 | 1.0 | 1.0 | 1.0 |

TABLE III-continued

| Smokeless Propellant Compositions With Varying Oxidizer Levels | | | | | |
|---|---|---|---|---|---|
| | Examples | | | | |
| Ingredients* (%) | 5 | 6 | 7 | 8 | 9 |
| PbSal | 2.0 | 2.0 | 2.0 | 2.0 | 2.0 |
| LBR | 2.0 | 2.0 | 2.0 | 2.0 | 2.0 |
| CB | 0.2 | 0.2 | 0.2 | 0.2 | 0.2 |

*See definitions, Table I.

All of the propellant compositions of Examples 5–9 are smokeless, have an elongation at −65° F. of at least 7%, and have a pressure exponent not exceeding 0.6.

EXAMPLE 10

A propellant composition of this invention containing 40% by weight of cyclotrimethylene trinitramine oxidizer (RDX) is prepared in accordance with the procedure of Example 1 and its mechanical properties evaluated. The propellant composition and properties are set forth in Table IV below. Low temperature strain capability (elongation) at −65° F. is 7%. Heat of explosion is measured and is 1036 calories/gram.

TABLE IV

| Composition* (%) | | | | | | | |
|---|---|---|---|---|---|---|---|
| NC | PGA/TDI | NG | RDX** | DnPA | NDPA | PbSal | LBR |
| 9.4 | 6.2 | 34.3 | 40.0 | 5.1 | 1.0 | 2.0 | 2.0 |

TABLE IV-continued

| Mechanical Properties | | | |
|---|---|---|---|
| Temperature (°F.) | Tensile Strength (p.s.i.) | Elongation (%) | Modulus (p.s.i.) |
| −65 | 2168 | 7 | 58,023 |
| −45 | 744 | 56 | 10,223 |
| +77 | 141 | 173 | 207 |
| +165 | 79 | 132 | 151 |

*See definitions, Table I.
**Nominal particle size 10μ.

In preparing the smokeless crosslinked double-base propellants of this invention, it is necessary that all ingredients be thoroughly dried. The cumulative overall water content of the propellant ingredients should not exceed 0.05% based on the total weight of the ingredients.

The solid propellant ingredients which include the nitrocellulose, and oxidizers such as cyclotetramethylene tetranitramine (HMX), and cyclotrimethylene trinitramine (RDX) are preferably vacuum dried at a reduced pressure of about 50 mm Hg at 140° F. for about 16 to 24 hours. These drying conditions will vary depending upon amounts of ingredients, and the type of drying ovens employed.

The lead salts which are employed in the smokeless propellants of this invention are preferably dried for 16 to 24 hours at about 110° C. at atmospheric or slightly reduced pressures. Carbon black employed in the propellant formulation can also be dried under the same conditions as the lead salts and are preferably dried therewith. In preparing the smokeless double-base crosslinked propellant of this invention the lead salts and carbon black are premixed in an inert liquid which is preferably a non-energetic plasticizer for nitrocellulose such as di-normal propyl-adipate or a liquid such as heptane which is easily removed from the propellant during vacuum mixing. The resulting mixture is a dispersion. To the dispersion of lead salts in inert liquid is added a mixture of solid oxidizer, a casting solvent and crosslinking agent. Nitrocellulose is added to the resulting mixture and mixing under vacuum in a vertical type mixer is continued until a uniform propellant matrix is obtained. The propellant slurry is then cast and cured at 125° F. or above for at least 10 days.

In preparing the propellant compositions of this invention as heretofore described it is critical that the lead salts be preblended prior to admixture with the other propellant ingredients. If pre-blending of the lead salts in an inert liquid is omitted from the process, these salts will agglomerate and lose their ballistic effectiveness in the propellant. To obtain a satisfactory pre-blend of lead salts, the weight ratio of inert liquid to lead salts should be at least about 1.20/1.0. If the weight ratio of non-energetic plasticizer in the composition to lead salts is below about 1.2/1.0 then an inert liquid such as heptane, benzene or ethylacetate is admixed with the lead salts to maintain the necessary weight ratio for preparing a suitable dispersion. When no non-energetic plasticizer is employed, the dispersion is prepared entirely with inert liquid which is subsequently removed from the propellant matrix during vacuum mixing.

The function of the lead salts, which is a critical part of the smokeless propellant composition of this invention, is to reduce pressure exponents of the propellant and to act as a catalyst in the crosslinking of the nitrocellulose binder with the prepolymer of a hydroxyterminated polyester and a diisocyanate. The catalytic effect of the lead salts on crosslinking is illustrated in the following example.

EXAMPLE 11

A propellant sample is prepared following the method of Example 1 and having the same composition as the propellant of Example 1. A second propellant sample is prepared following the general procedure of Example 1, but omitting the addition of any lead salts. The formulation of the second propellant is essentially the same as that of Example 1 with the exception of the omission of lead salts. These propellant samples are cured for one day at 140° F. The resulting propellants are each immersed in acetone to determine acetone solubility which is a measure of crosslinking. The propellant prepared with the lead salts retains its shape and undergoes only a little swelling, indicating that crosslinking has taken place. The second propellant sample not containing lead salts completely disintegrates indicating that no crosslinking has taken place. The catalytic effect of the lead salts on crosslinking of the binder is therefore clearly shown.

Illustrative lead salts which can be employed in the propellant compositions of this invention are lead salicylate, lead beta-resorcylate, lead monoxide, lead stearate, lead dioxide, lead tetraoxide, lead phthalate, lead benzoate, lead 2-ethyl hexonate, lead acetyl salicylate, and mixtures thereof. Still other suitable lead salts that can be employed are described in U.S. Pat. No. 3,033,718 to Ralph F. Preckel. The amount of lead salts employed in the propellant composition of this invention can vary from about 0.5% to about 6% by weight based on the total weight of the propellant composition. If less than 0.5% by weight of lead salts are employed poor ballistic properties result, and in particular pressure exponents exceed 0.6. If more than about 6% by weight of lead salts are employed, smokiness results and propellant energy is lowered. The preferred lead salts are lead salicylate, lead beta-resorcylate and mixtures thereof which are preferably employed in an amount of from 2% to 4% by weight based on the weight of the propellant.

Following the mixing of the propellant slurry as heretofore described, the propellant is cast into any suitable mold or container. The propellant is then cured for at least about 10 days at 125° F. When higher curing temperatures are employed somewhat shorter curing times are satisfactory. For example, curing of these propellants for at least about 7 days at 140° F. is satisfactory. Curing of the propellants of this invention for less than 10 days at 125° F. is not satisfactory in that constant mechanical property values are not obtained.

Mechanical properties of the smokeless propellants of this invention are controlled by the relative levels of nitrocellulose, crosslinking agent, plasticizer (including both energetic plasticizer and non-energetic plasticizer) and oxidizer. To maintain high strain capability or elongation at the low operational temperatures required for tactical propellants of −65° F. the plasticizer to nitrocellulose ratio should be as high as possible consistent with high tensile strength requirements at high temperatures. Thus, when preparing a smokeless propellant composition of this invention it is preferred to maintain the total plasticizer to nitrocellulose ratio at from about 4.2/1.0 to about 6.6/1.0.

The desirability of employing a non-energetic plasticizer in formulating the smokeless crosslinked propellant of this invention will depend upon the specific application in which the propellant will be employed. Referring to Examples 3 and 4, it is apparent that the presence of the di-n-propyladipate plasticizer in Example 3 results in substantially higher strain capability at low temperatures than a similar propellant formulation of Example 4 where no inert plasticizer is employed. It is also noted, however, that the smokeless propellant of Example 4 has higher specific impulse (See Table 1), than the propellant composition of Example 3.

Propellant mechanical properties are affected by the weight ratio of nitrocellulose to the crosslinking agent employed. Preferred weight ratios are from about 1.8/1.0 to about 0.7/1.0. It is clear that within the compositional ranges of this invention propellant mechanical and ballistic properties can be varied for a particular application while still maintaining the properties of smokelessness, pressure exponents of less than about 0.6, and elongations of at least 7% at −65° F.

Illustrative inert or non-energetic plasticizers which can be employed include all of the well known non-energetic plasticizers for nitrocellulose such as di-n-propyladipate, triacetin, tri-n-butyl phosphate, dimethyl phthalate, mixtures thereof and the like. Di-n-propyladipate is the preferred non-energetic plasticizer. The amount of non-energetic plasticizer employed is from 0% to about 8% by weight based on the weight of the propellant. If the non-energetic plasticizer content exceeds about 8% by weight of the propellant, the propellant will tend to become smoky upon burning, and the heat of explosion of the propellant is reduced. It is generally preferred to employ from 0% to about 5% by weight of non-energetic plasticizer in these propellants.

The nitrocellulose which is employed in the propellant composition of this invention is manufactured by densification of fibrous nitrocellulose through the action of one or more solvents for the nitrocellulose which partially gelatinize the nitrocellulose without dissolution thereof. The nitrocellulose is employed in the form of tiny particles having a diameter of from about 3μ to about 30μ and generally having a nominal median particle diameter of about 10μ. A smooth, hard, dense shell of colloided nitrocellulose comprises the surface of each tiny particle. This type of nitrocellulose resists rapid absorption of typical casting liquids employed in manufacture of double-base propellants by a slurry casting process. The amount of nitrocellulose employed in the propellant composition of this invention can vary from about 7% to about 17% by weight, based on the weight of propellant. A preferred nitrocellulose content is from about 7% to about 15%.

The crosslinking agents which can be employed in this invention are prepolymers of hydroxy terminated polyesters and diisocyanates. The preferred crosslinking agent is the prepolymer of polyglycol adipate and tolylene 2,4-diisocyanate having a molecular weight range of from about 1000 to about 2200 and an average NCO content of from about 3% to about 7% by weight based on the weight of the prepolymer. The crosslinking agent is preferably admixed with the energetic plasticizer prior to addition to the mixer. Other crosslinking agents which can be employed include prepolymers prepared by reaction of hydroxy terminated polyesters such as hydroxy terminated polyesters obtained by reaction of polyethylene glycol, polydiethylene glycol, polypropylene glycol, polybutylene glycol, polyhexamethylene glycol, mixtures thereof, and the like with dibasic acids such as succinic acid, adipic acid, azelaic acid, sebacic acid, oxadibutyric acid, mixtures thereof and the like. Illustrative diisocyanates which can be employed to react with the hydroxy terminated polyesters to prepare suitable prepolymer crosslinking agents include alkane diisocyanates such as ethylene diisocyanate, trimethylene diisocyanate, hexamethylene diisocyanate and decamethylene diisocyanate; alkene diisocyanates such as 1-propylene-1,2-diisocyanate and 1-butylene-1,3-diisocyanate; alkylidene diisocyanates such as ethylidene diisocyanate and propylidene-1,1-diisocyanate; aromatic diisocyanates such as m-phenylene diisocyanate; p-phenylene diisocyanate; 2,4-tolylene diisocyanate; 2,6-tolylene diisocyanate; 4,4'-diphenylmethane diisocyanate; naphthalene-1,5-diisocyanate; m-xylylene diisocyanate; 3,3-dimethoxy-4,4'-biphenylene diisocyanate; mixtures thereof and the like.

The organic oxidizers employed in preparing the smokeless crosslinked double base propellants of this invention are solids and include cyclotetramethylene tetranitramine, (HMX) and cyclotrimethylene trinitramine (RDX), mixtures thereof and the like. The solid oxidizers can be employed in an amount of from 0% to about 60% by weight based on the weight of the propellant. Oxidizer particle size is important especially when oxidizer loadings in excess of 40% by weight are employed. It is generally necessary to employ oxidizers of larger particle sizes, exceeding 10μ or to employ bimodal blends of oxidizers to prepare readily processable propellant when the oxidizer content is in excess of 40% by weight. Preferred compositions of this invention employ from about 10% to about 40% by weight of organic oxidizer.

Nitroglycerin is the preferred energetic plasticizer for nitrocellulose which is employed in preparing the double-base crosslinked propellants of this invention. Other energetic plasticizers which can be employed include diethyleneglycol dinitrate, triethyleneglycol dinitrate, and butanetriol trinitrate, bis(dinitropropyl)acetal, bis(dinitropropyl)formal, and the like. These energetic plasticizers are employed in an amount of from about 27% to about 63% by weight based on the weight of the propellant. A preferred weight range of nitroglycerin in the propellant compositions of this invention is from about 34% to about 56%. Energetic plasticizers are stabilized primarily with 2-nitrodiphenylamine, N-methyl p-nitroaniline, or mixtures thereof. The amount of stabilizer which is employed is from about 0.5% to about 6% by weight based on the weight of the energetic plasticizer.

Carbon black is incorporated into the smokeless propellant composition of this invention in an amount of from about 0.1% to about 0.9% by weight, based on the weight of the propellant composition. The carbon black is employed as finely divided particles having an average particle size of less than about 1μ and preferably of about 0.01μ. The carbon black in the smokeless propellants of this invention enhances burning rates and improves (lowers) the pressure exponent. When more than about 0.9% by weight of carbon black is employed the propellant viscosity becomes high making processing difficult and a tendency towards smokiness occurs due to alteration of the oxygen balance of the system. If less than about 0.1% by weight of carbon black is employed almost no effect on burning rate and pressure exponent is obtained. It is generally preferred to employ from about 0.2% to about 0.5% by weight of carbon black in the propellant compositions of this invention.

What I claim and desire to protect by Letters Patent is:

1. A smokeless crosslinked double-base propellant comprising by weight
(a) from about 7% to about 17.0% nitrocellulose,
(b) from about 27% to about 63% energetic plasticizer,
(c) from about 4% to about 12% of a crosslinking agent which is a prepolymer prepared by reaction of a hydroxy-terminated polyester and a diisocyanate,
(d) from about 0% to about 8% non-energetic plasticizer,
(e) from about 0.5% to about 6% of lead salt,
(f) from about 0.1% to about 0.9% carbon black, and
(g) from about 0% to about 60% of oxidizer comprising cyclotrimethylene trinitramine, cyclotetramethylene tetranitramine, and mixtures thereof.

2. The smokeless crosslinked double-base propellant of claim 1 wherein the crosslinking agent is a prepolymer of polygylcol adipate and tolylene 2,4-diisocyanate.

3. The smokeless crosslinked double-base propellant of claim 2 wherein the energetic plasticizer is nitroglycerin.

4. The smokeless crosslinked double-base propellant of claim 3 wherein the non-energetic plasticizer is di-n-propyladipate.

5. The smokeless crosslinked double-base propellant of claim 4 wherein the weight ratio of nitrocellulose to the prepolymer of polyglycol adipate-tolylene 2,4-diisocyanate is from about 1.8/1.0 to about 0.7/1.0.

6. The smokeless crosslinked double-base propellant of claim 5 wherein the weight ratio of total plasticizer to nitrocellulose is from about 4.2/1.0 to about 6.6/1.0.

7. A smokeless crosslinked double-base propellant comprising by weight:
(a) from about 7% to about 15% nitrocellulose,
(b) from about 34% to about 56% nitroglycerin,
(c) from about 4% to about 10% of a prepolymer consisting essentially of the reaction product of polyglycol adipate and tolylene 2,4-diisocyanate, said prepolymer having a molecular weight range of from about 1000 to about 2000 and an average NCO content from about 3% to about 7% by weight, based on the weight of the prepolymer,
(d) from about 0% to about 5% of di-n-propyl-adipate,
(e) from about 2% to about 4% of lead salts selected from the groups consisting of lead salicylate, lead beta-resorcylate and mixtures thereof,
(f) from about 0.2% to about 0.5% carbon black, and
(g) from about 10% to about 40% of organic oxidizer selected from the group consisting of cyclotrimethylene trinitramine, cyclotetramethylene tetranitramine, and mixtures thereof.

8. The method of manufacture of smokeless crosslinked double-base propellant comprising:
(a) forming a dispersion of lead salts in inert liquid,
(b) admixing the lead salt dispersion with nitroglycerin, an organic oxidizer and a crosslinking agent which is a prepolymer consisting essentially of the reaction product of a hydroxy terminated polyester and a diisocyanate, to form a slurry,
(c) admixing nitrocellulose with the slurry and subjecting the resulting admixture to reduced pressure while maintaining agitation and continuing agitation until a smooth free flowing slurry results,
(d) casting the slurry into a mold, and
(e) curing the slurry.

9. The method of claim 8 wherein the weight ratio of inert liquid to lead salt is at least about 1.2/1.0.

10. The method of claim 9 wherein the propellant is cured at 125° F. or above for at least 10 days.

11. The method of claim 8 wherein the inert liquid is a non-energetic plasticizer for nitrocellulose.

12. The method of claim 11 wherein the inert liquid is a material selected from the group consisting of di-n-propyladipate, triacetin, tri-n-butyl phosphate, dimethyl phthalate, and mixtures thereof.

13. The process of claim 8 wherein the inert liquid is a liquid selected from the group consisting of heptane, benzene and ethyl acetate.

* * * * *